US011255570B2

(12) United States Patent
Fujita et al.

(10) Patent No.: US 11,255,570 B2
(45) Date of Patent: Feb. 22, 2022

(54) CEILING-EMBEDDED AIR CONDITIONER

(71) Applicant: FUJITSU GENERAL LIMITED, Kanagawa (JP)

(72) Inventors: Naoto Fujita, Kanagawa (JP); Yuta Nakamura, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 330 days.

(21) Appl. No.: 16/157,607

(22) Filed: Oct. 11, 2018

(65) Prior Publication Data

US 2019/0063782 A1 Feb. 28, 2019

Related U.S. Application Data

(63) Continuation of application No. 14/866,145, filed on Sep. 25, 2015, now Pat. No. 10,365,007.

(30) Foreign Application Priority Data

Sep. 30, 2014 (JP) ..... JP2014-201523
Sep. 30, 2014 (JP) ..... JP2014-201524

(51) Int. Cl.
*F24F 13/14* (2006.01)
*F24F 1/0014* (2019.01)
(Continued)

(52) U.S. Cl.
CPC ..... *F24F 13/14* (2013.01); *F24F 1/0014* (2013.01); *F24F 1/0047* (2019.02); *F24F 1/0083* (2019.02); *F24F 2013/0616* (2013.01)

(58) Field of Classification Search
CPC ..... F24F 1/0007; F24F 1/0014; F24F 1/0047; F24F 13/06; F24F 13/10; F24F 13/14; F24F 13/20; F24F 2013/0616
(Continued)

(56) References Cited

U.S. PATENT DOCUMENTS 10,352,582 B2 * 7/2019 Kojima ..... F24F 1/0047
2006/0276123 A1 * 12/2006 Sanagi ..... F24F 1/0011 454/292
(Continued)

FOREIGN PATENT DOCUMENTS

EP 1688678 A1 8/2006
JP 2001133032 A2 5/2001
(Continued)

OTHER PUBLICATIONS

The Engineering Tool Box, Rectangular and Circular HVAC Ducts—Equivalent Diameter, Feb. 8, 2014, https://www.engineeringtoolbox.com/equivalent-diameter-d_443.html (Year: 2014).*
(Continued)

*Primary Examiner* — Larry L Furdge
*Assistant Examiner* — Chang H Park
(74) *Attorney, Agent, or Firm* — Rankin, Hill & Clark LLP

(57) ABSTRACT

A ceiling-embedded air conditioner includes: a box-shaped housing that is embedded in a ceiling of an air-conditioned room; a square decorative panel that is attached to a lower surface of the housing and covers the ceiling; main body outlets that are provided along respective four sides of a bottom surface of the housing and blow heat-exchanged air; outlets that are provided in the decorative panel in correspondence with the main body outlets; corner blowoff units that are provided in the decorative panel in correspondence with coupling portions for coupling the outlets; a blowoff path that is circumferentially provided in the decorative panel in correspondence with the outlets and the corner blowoff units; and wind direction plates that are rotatably provided along the respective sides of the decorative panel so as to cover or open the blowoff path and are longer than a long side of the outlets.

3 Claims, 8 Drawing Sheets

(51) Int. Cl.
*F24F 1/0047* (2019.01)
*F24F 1/0083* (2019.01)
*F24F 13/06* (2006.01)

(58) Field of Classification Search
USPC ..... 62/408
See application file for complete search history.

(56) References Cited

U.S. PATENT DOCUMENTS

| | | | | |
|---|---|---|---|---|
| 2009/0025414 | A1* | 1/2009 | Koga | F24F 13/20 62/263 |
| 2010/0192611 | A1 | 8/2010 | Yamaguchi | |

FOREIGN PATENT DOCUMENTS

| | | | | |
|---|---|---|---|---|
| JP | 2005249328 | A * | 9/2005 | F24F 1/0014 |
| JP | 2005249328 | A2 | 9/2005 | |
| JP | 4052264 | | 2/2008 | |
| JP | 2008-064396 | | 3/2008 | |
| WO | 2011064999 | | 6/2011 | |

OTHER PUBLICATIONS

Extended European Search Report dated May 2, 2016 for European Patent Application No. 15187646.3.

* cited by examiner

CEILING-EMBEDDED AIR CONDITIONER

CROSS-REFERENCE TO RELATED APPLICATION

This application claims priority from Japanese Patent Application Nos. 2014-201523 and 2014-201524 filed with the Japan Patent Office on Sep. 30, 2014, the entire contents of which are hereby incorporated by reference.

BACKGROUND

1. Technical Field

One embodiment of the present disclosure relates to a ceiling-embedded air conditioner in which a housing is embedded in a ceiling.

2. Description of the Related Art

The ceiling-embedded air conditioner has a box-shaped housing including a heat exchanger and a blowing fan (turbo fan) and embedded in a ceiling. A suction grill in a decorative panel at the lower part of the housing sucks air in. The heat exchanger performs heat exchange between the sucked air and a refrigerant. The heat-exchanged air is adjusted in wind direction by wind direction plates and delivered from outlets into a room. This type of air conditioners is used in relatively large rooms in offices or stores.

A typical ceiling-embedded air conditioner has a suction grill at the center of an almost square decorative panel and outlets around the suction grill along the respective sides of the square decorative panel. The air conditioner also has wind direction plates suited to the shape of the outlets to cover the outlets. Motors for driving the wind direction plates are attached to the back surface of the decorative panel (refer to JP-A-2008-64396). In this structure, however, the blown air is supplied in the directions of the four sides of the ceiling-embedded air conditioner but is unlikely to be supplied in the directions of the four corners of the same.

Another typical ceiling-embedded air conditioner has a blowoff path around almost the entire circumference of a drain pan in the housing. The air conditioner is provided with a decorative panel, outlets, and auxiliary outlets. The outlets and the auxiliary outlets are disposed in an almost octagon shape. This allows the air to be blown in almost all directions (refer to Japanese Patent No. 4052264).

SUMMARY

A ceiling-embedded air conditioner includes: a box-shaped housing that is embedded in a ceiling of an air-conditioned room and has a blowing fan and a heat exchanger; a square decorative panel that is attached to a lower surface of the housing and covers the ceiling; main body outlets that are provided along respective four sides of a bottom surface of the housing and blow heat-exchanged air; outlets that are provided in the decorative panel so as to correspond to the main body outlets; corner blowoff units that are provided in the decorative panel so as to correspond to coupling portions for coupling the outlets; a blowoff path that is circumferentially provided in the decorative panel so as to correspond to the outlets and the corner blowoff units; and wind direction plates that are rotatably provided along the respective sides of the decorative panel so as to cover or open the blowoff path and are longer than a long side of the outlets.

DESCRIPTION OF THE EMBODIMENTS

Figure 1:
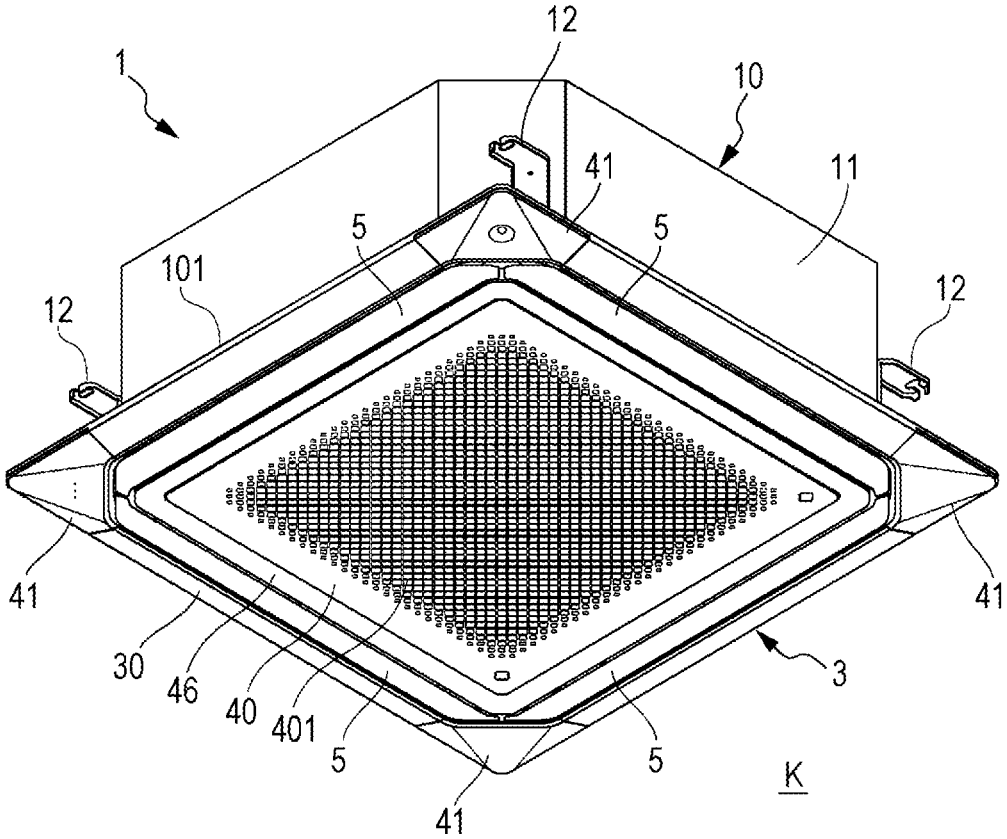
FIG. 1 is an external view of a ceiling-embedded air conditioner in the shutdown state.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to the technique described in Japanese Patent No. 4052264, a large number of outlets are provided to complicate the structure of the housing. In particular, the drain pan is opened at almost the entire circumference and is supported by a reinforcement rib. Accordingly, the drain pan is decreased in strength. The wind direction plates are also provided at the auxiliary outlets to increase the number of components.

The wind direction plates are provided at all of the outlets and the auxiliary outlets in an almost octagon shape. Accordingly, the motors are attached to the respective wind direction plates to bring about increase in the number of components. The outlets are adjacent to each other and it is thus difficult to assure the spaces for attachment of the motors.

One object of the present disclosure is to provide a ceiling-embedded air conditioner as described below. That is, the ceiling-embedded air conditioner blows air in all directions (or almost all directions) without auxiliary outlets. This reduces temperature variations in an air-conditioned room and allows efficient air conditioning in large rooms.

Another object of the present disclosure is to provide a ceiling-embedded air conditioner as described below. That is, the ceiling-embedded air conditioner is provided with a blowoff path for guiding the air blown from the outlets to the corners of the decorative panel, and wind direction plates. This allows the ceiling-embedded air conditioner to blow air in all directions (or almost all directions) without having to provide auxiliary outlets. The ceiling-embedded air conditioner is further provided with motors for rotating the wind direction plates within the blowoff path. This ensures the spaces for attachment of the motors.

A ceiling-embedded air conditioner (the air conditioner) according to one embodiment of the present disclosure includes: a box-shaped housing that is embedded in a ceiling of an air-conditioned room and has a blowing fan and a heat exchanger; a square decorative panel that is attached to a lower surface of the housing and covers the ceiling; main body outlets that are provided along respective four sides of a bottom surface of the housing and blow heat-exchanged air; outlets that are provided in the decorative panel so as to correspond to the main body outlets; corner blowoff units that are provided in the decorative panel so as to correspond to coupling portions for coupling the outlets; a blowoff path that is circumferentially provided in the decorative panel so as to correspond to the outlets and the corner blowoff units; and wind direction plates that are rotatably provided along the respective sides of the decorative panel so as to cover or open the blowoff path and are longer than a long side of the outlets.

In the air conditioner, the wind direction plates may have wind direction portions and auxiliary wind direction portions, the wind direction portions being opposed to the outlets and the auxiliary wind direction portions being provided at the ends of the wind direction portions and opposed to the coupling portions. The corner blowoff units may include: bottom paths that are provided in the blowoff path at positions corresponding to the coupling portions; and the auxiliary wind direction portions of the wind direction plates.

In the air conditioner, the wind direction plates may be configured such that, when the wind direction plates open the blowoff path, end portions of the auxiliary wind direction portions come under the bottom paths.

In the thus configured ceiling-embedded air conditioner according to one embodiment of the present disclosure, the wind direction plates are rotatable and movable within the blowoff path. In this case, the air blown from the outlets is guided to the corners (corner blowoff units) of the blowoff path through the space between the wind direction plates (auxiliary wind direction portions) and the blowoff path. The foregoing air and the air from the adjacent wind direction plates join together at the corner blowoff units.

The joining air is blown toward vacant spaces. Specifically, the joining air is blown from the tips of the adjacent wind direction plates (auxiliary wind direction portions) to the outside of the decorative panel. Accordingly, the ceiling-embedded air conditioner can blow air in all directions (or almost all directions) without having to provide auxiliary outlets. Therefore, the ceiling-embedded air conditioner allows efficient air conditioning in large rooms.

In the air conditioner, the blowoff path may include concaves continuously provided around the outlets and the coupling portions. The wind direction plates may be rotatably attached within the concaves (blowoff path) to cover or open the blowoff path. In this case, when the air conditioner is shut down (that is, the wind direction plates cover the blowoff path), the wind direction plates are flush or almost flush with the surface of the decorative panel. This improves design of the air conditioner.

In the air conditioner, the motors may be fixed to the blowoff path integrally with the motor covers.

Each of the motor covers may have a shape symmetric with respect to diagonal lines of the decorative panel, and include two motor storage portions at both sides of the diagonal lines that store the two motors for driving the two wind direction plates corresponding to the two outlets coupled via the coupling portion. The motor storage portions may be inclined to be higher at the outlet side and lower at the inside of the blowoff path and the diagonal line side of the decorative panel. Bottom paths included in the corner blowoff units may be formed between the motor storage portions in the motor cover.

Furthermore, in the air conditioner, when the wind direction plates are rotated by the motors to open the blowoff path, the outlets may be divided by the wind direction plates into main blowoff portions and auxiliary blowoff portions and the motor storage portions of the motor covers may form wall surfaces at the main blowoff portion side.

In the thus configured air conditioner, the motors for rotating the wind direction plates are fixed in the blowoff path integrally with the motor covers for storing the motors. This allows air blowing in almost all directions and ensures the spaces for attachment of the motors. Further, the motors (and the motor covers) can be attached or detached through the surface of the decorative panel. This eliminates the need to remove the decorative panel from the housing at the time of maintenance of the motors, for example. This results in improvement of workability.

The motor covers may be symmetrical with respect to the diagonal lines of the decorative panel and include the motor storage portions at both sides of the diagonal lines. In this case, the bottom paths may be formed between the motor storage portions in the motor covers. Accordingly, the airs guided by the wind direction plates join together at the bottom paths. The joining air is blown outward along extensions of the diagonal lines of the decorative panel.

An embodiment of the present disclosure will be described below in detail. However, the technique in the present disclosure is not limited to the foregoing embodiment.

<Ceiling-Embedded Air Conditioner>

A ceiling-embedded air conditioner 1 (hereinafter, referred to as air conditioner 1) according to the embodiment includes a box-shaped housing 10 embedded in a ceiling surface T of an air-conditioned room K and a square decorative panel 3 attached to a lower surface 101 of the housing 10. The housing 10 is set in the ceiling by being hung on a plurality of hanging bolts not illustrated embedded in the back wall surface of the ceiling with the use of a plurality of attachment brackets 12 included in side plates 11 of the housing 10. The decorative panel 3 is attached to the housing 10 by screwing attachment portions 332 described later to the attachment brackets 12 from the air-conditioned room K side. The decorative panel 3 covers the lower surface 101 of the housing 10 and the ceiling surface T in the air-conditioned room K around the lower surface 101.

<Housing>

Figure 2:
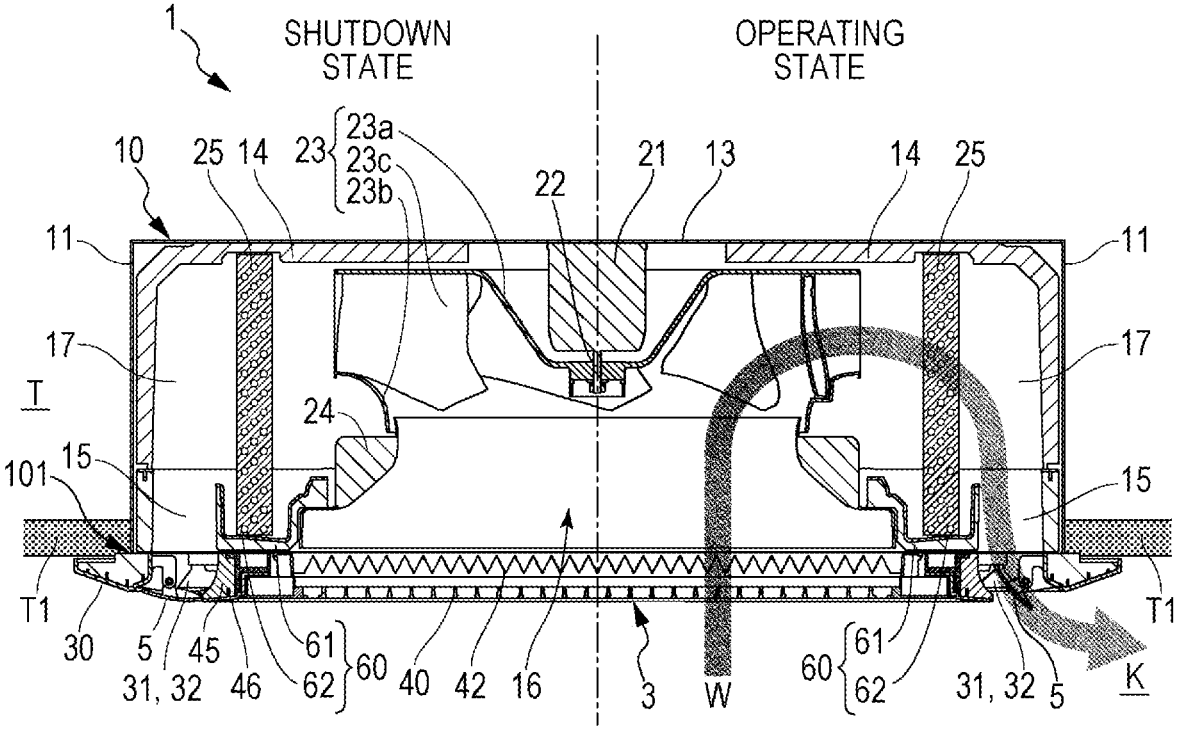
FIG. 2 is a cross-sectional view of the ceiling-embedded air conditioner, and the right side indicates the operating state and the left side indicates the shutdown state.

The case of the housing 10 includes a top plate 13 made from a metal plate and the side plates 11 extended downward from the outer periphery of the top plate 13. Heat insulating members 14 are provided on the inner peripheral surfaces of the top plate 13 and the side plates 11 as illustrated in FIG. 2. A fan motor 21 is screwed into the inside of center of the top plate 13. A shaft 22 extended downward from the fan motor 21 supports pivotally a hub 23*a* of a blowing fan 23. The blowing fan 23 is a so-called turbo fan including the hub 23*a*, a shroud 23*b*, and a plurality of blades 23*c*. The blowing fan 23 is arranged together with the fan motor 21 at almost the center of inside of the housing 10.

Figure 3:
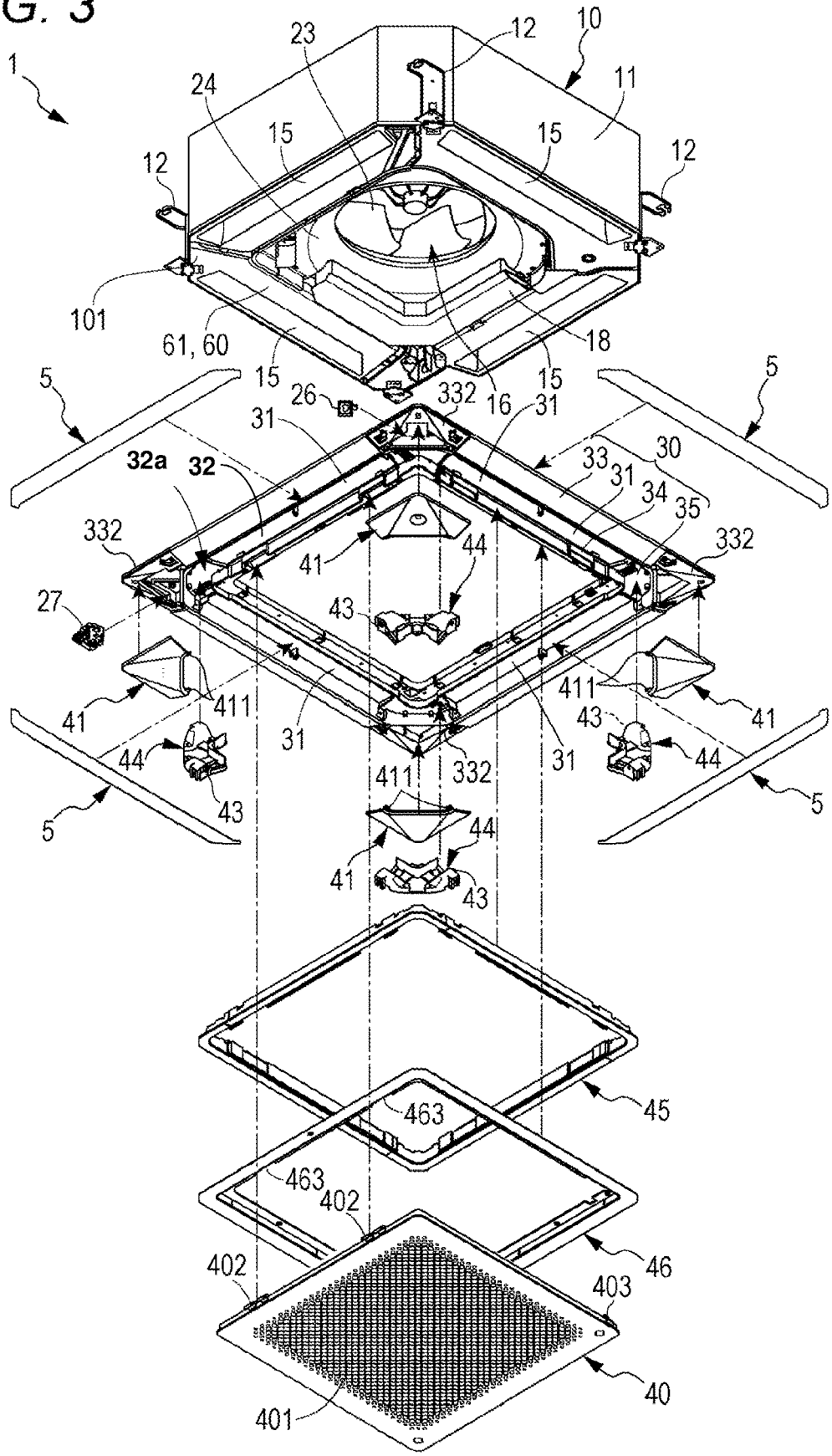
FIG. 3 is an exploded view of the ceiling-embedded air conditioner.

As illustrated in FIGS. 2 and 3, a drain pan 60 covers the lower part of the housing 10. The drain pan 60 includes a heat insulating member 61 and a drain pan plate 62 described later. The drain pan 60 has an opening at the center that constitutes a suction opening 16. A bell mouth 24 is disposed in the suction opening 16 to couple the suction opening 16 and the blowing fan 23. An electrical equipment box 18 is disposed in the bell mouth 24 at the suction opening 16 side. The electrical equipment box 18 is L-shaped so as not to interfere with air W passing through the suction opening 16. The electrical equipment box 18 stores electrical component controlling the air conditioner 1.

The blowing fan 23 rotatably driven by the fan motor 21 sucks the room air W from the suction opening 16 into the housing 10. The air W sucked into the housing 10 is guided to the blowing fan 23 along the bell mouth 24 and then is blown toward the outside of the blowing fan 23.

A heat exchanger 25 is disposed around the blowing fan 23 to surround the blowing fan 23. The heat exchanger 25 is vertically sandwiched between the heat insulating members 14 and the drain pan 60. A resin drain pan plate 62 is provided on the surface of the drain pan 60 opposed to and receiving the lower part of the heat exchanger 25. The rein drain pan plate 62 is molded integrally with a foamed-resin heat insulating member 61 to receive drain water generated by the heat exchanger 25. The drain water is discharged to the outside of the room through a drain pump and a drain pipe coupled to the drain pump not illustrated.

The heat exchanger 25 is coupled to a reversible refrigeration cycle circuit (not illustrated) capable of cooling operation and heating operation. During the cooling operation, the heat exchanger 25 serves as an evaporator to cool the air W guided by the blowing fan 23. Meanwhile, during the heating operation, the heat exchanger 25 serves as a condenser to heat the air W guided by the blowing fan 23.

A blowing path 17 is formed by the space between the heat exchanger 25 and the heat insulating members 14 around the side plates 11 and four main body outlets 15 provided in the drain pan 60 along the respective four sides of the housing 10. The blowing path 17 guides the air W blown from the blowing fan 23 to outlets 31 of the decorative panel 3 described later. The outlets 31 are provided in the decorative panel 3 so as to correspond to the main body outlets 15. The air W heat-exchanged with a refrigerant by the heat exchanger 25 passes through the blowing path 17 and the main body outlets 15 and is blown from the outlets 31 into the air-conditioned room K.

The air conditioner 1 can blow air in all directions (or almost all directions) with a blowoff path 32 and corner blowoff units 36 described later, without having to provide auxiliary outlets unlike in the typical air conditioners. Accordingly, the drain pan 60 does not need openings for auxiliary outlets. This maintains the strength of the drain pan 60.

<Decorative Panel>

Figure 4:
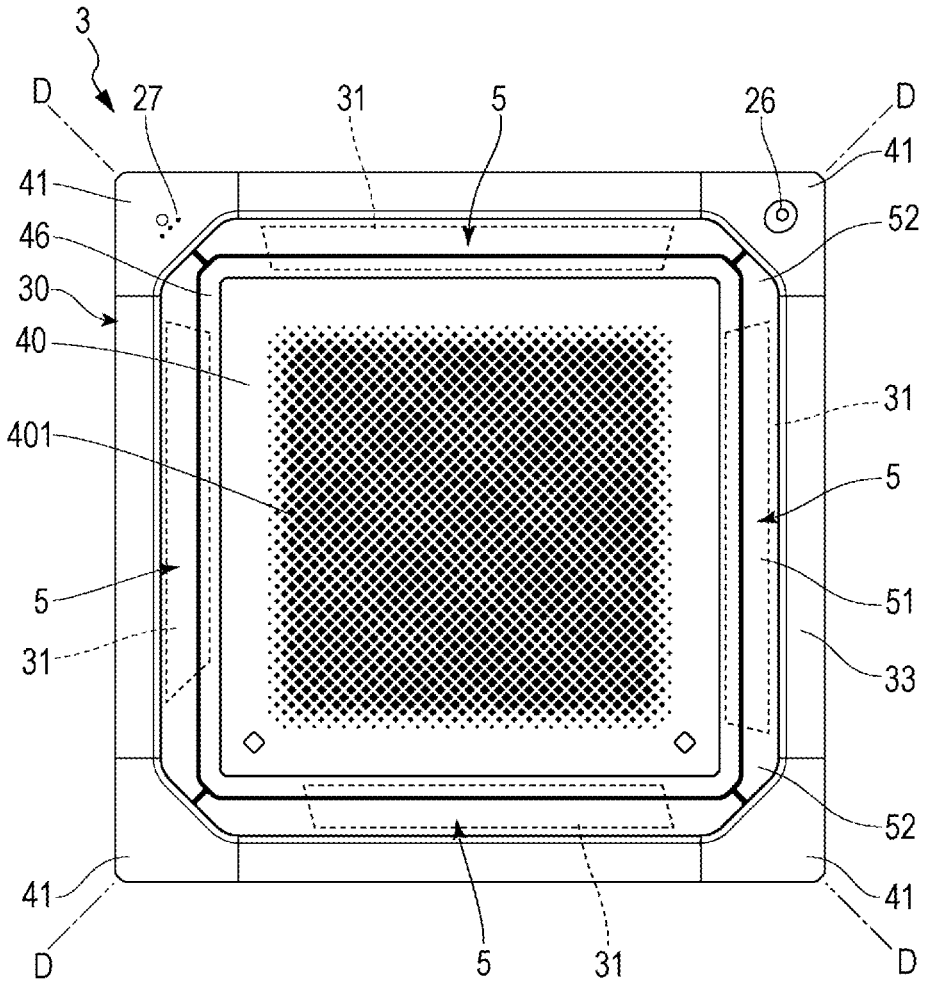
FIG. 4 is a front view of the ceiling-embedded air conditioner in the shutdown state.

As described above, the decorative panel 3 is attached to the lower surface 101 of the housing 10. The decorative panel 3 is a square frame-shaped plate body as illustrated in FIG. 4, for example. The decorative panel 3 covers the lower surface 101 of the housing 10. Further, when the air conditioner 1 is attached to the ceiling surface T1, the decorative panel 3 covers the ceiling surface T1 around the lower surface 101 of the housing 10. The decorative panel 3 and another square body described later may include corners chambered by a straight line with an arc. As illustrated in FIGS. 3 and 4, the decorative panel 3 covers the ceiling surface T1. The decorative panel 3 has a decorative panel main body 30 with outlets 31, a suction grill 40, corner panels 41, four wind direction plates 5, motors 43, four motor covers 44, a panel heat insulating member 45, and a suction grill frame 46. The suction grill 40 is detachably attached to the center of the decorative panel main body 30. The corner panels 41 cover corners 30*a* of the decorative panel main body 30. The four wind direction plates 5 are attached to the outlets 31 of the decorative panel main body 30. The motors 43 drive the respective four wind direction plates 5. The four motor covers 44 fix the motors 43 to the decorative panel main body 30 and serve also as motor fixtures. The panel heat insulating member 45 forms the inner walls of the outlets 31. The suction grill frame 46 receives the suction grill 40 and serves also as a fixture for fixing the panel heat insulating member 45 to the decorative panel main body 30.

<Decorative Panel Main Body>

Figure 5:
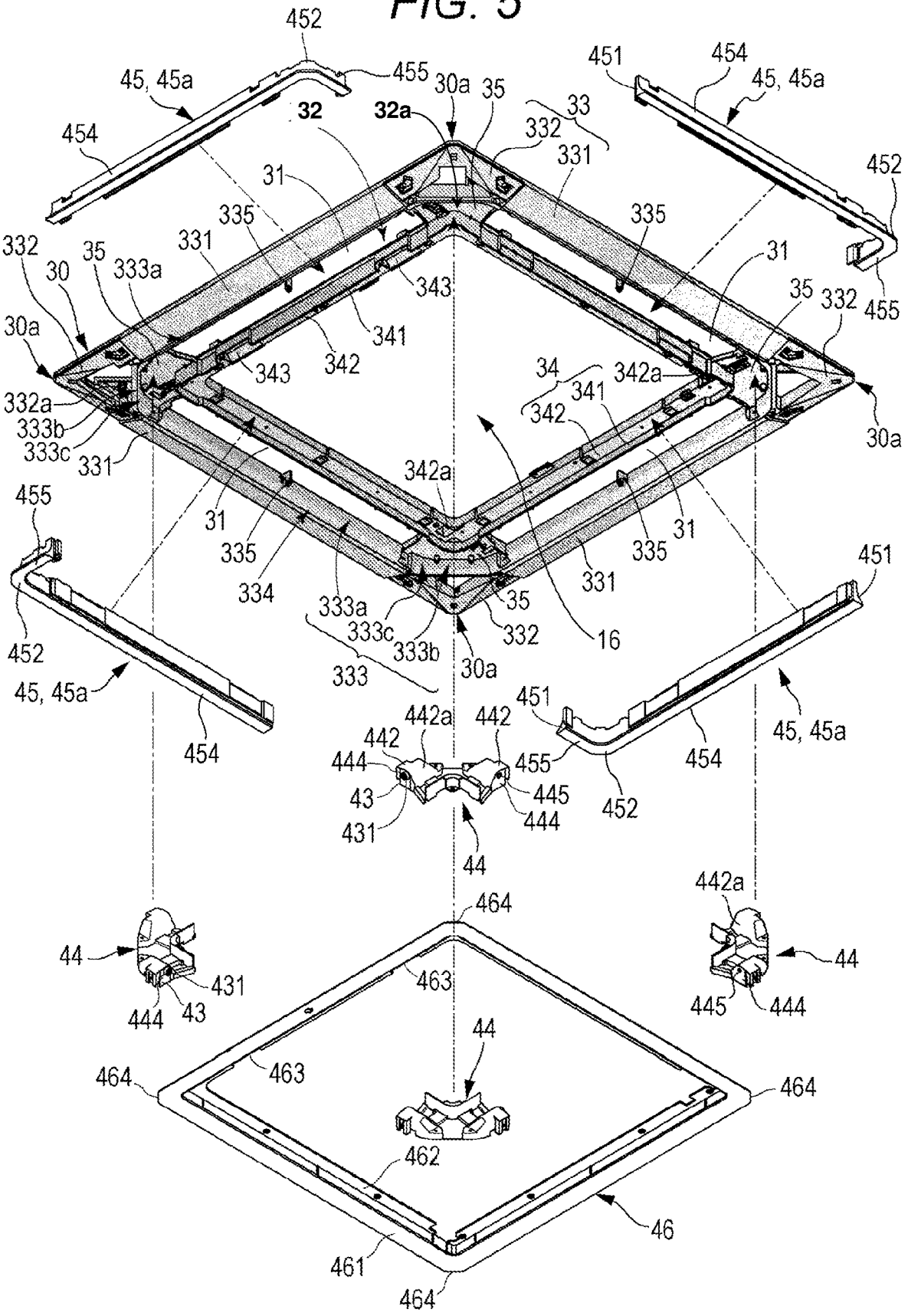
FIG. 5 is an exploded view of a decorative panel in the ceiling-embedded air conditioner.

As illustrated in FIG. 5, the decorative panel main body 30 includes an outer frame portion 33, an inner frame portion 34, and coupling portions 35. The outer frame portion 33 is a square frame body, for example. The inner frame portion 34 stores the suction grill 40. The inner frame portion 34 is located closer to the center of the decorative panel main body 30 than the outer frame portion 33 is. The coupling portions 35 couple the outer frame portion 33 and the inner frame portion 34 in one plane at the corners 30*a* of the decorative panel main body 30 at the housing 10 side. The openings among the outer frame portion 33, the inner frame portion 34, and the coupling portions 35 constitute the outlets 31 corresponding to the main body outlets 15. That is, the coupling portions 35 couple the adjacent outlets 31.

Concaves 32*a* are formed around the outlets 31. Each of the concaves 32*a* is surrounded by the outer frame portion 33 and the inner frame portion 34. The coupling portions 35 partially constitute the bottom surfaces of the concaves 32*a*. The concaves 32*a* are continuously coupled to form the blowoff path 32. The blowoff path 32 guides the air blown from auxiliary blowoff portions 312 described later to the corners of the decorative panel. The blowoff path 32 is circumferentially provided (in a square shape, for example) in the decorative panel 3 so as to correspond to the outlets 31 and the corner blowoff units 36 described later (coupling portions 35). For example, the blowoff path 32 is provided along almost the entire circumference of the suction grill 40 described later. That is, the blowoff path 32 includes the concaves 32*a* continuously provided around the outlets 31 and the coupling portions 35.

<Outer Frame Portion>

Figure 6:
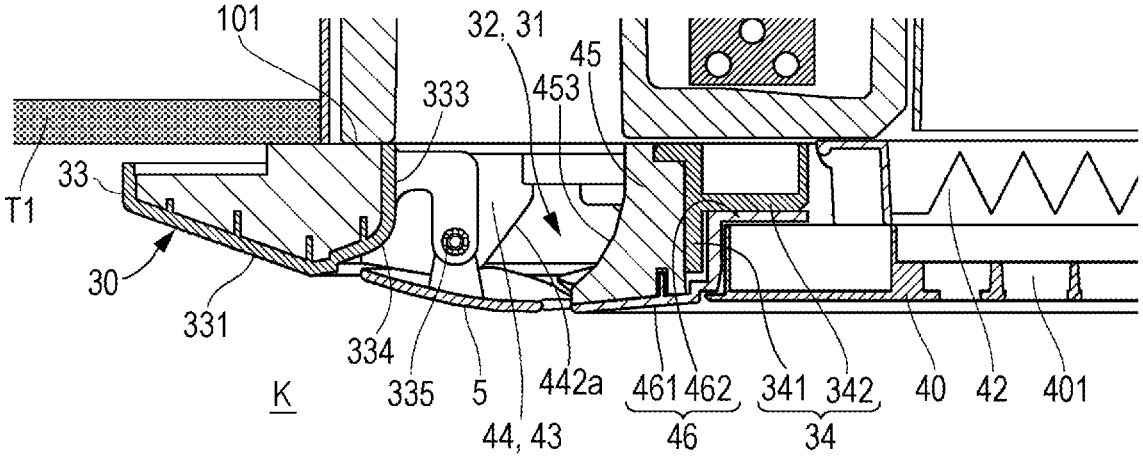
FIG. 6 is an enlarged view of FIG. 2 in the shutdown state.

The outer frame portion 33 has decorative surfaces 331 at portions corresponding to the four sides of the square decorative panel main body 30 as illustrated in FIGS. 5 and 6. The decorative surfaces 331 are inclined so as to be higher at the outlet 31 side and lower at the ceiling surface T1 side. Attachment portions 332 are provided at the four corners 30*a* coupling the decorative surfaces 331. The decorative panel 3 can be fixed to the housing 10 by screwing the attachment brackets 12 of the decorative panel 3 into screw holes 332*a* of the attachment portions 332. A human detection sensor 26 and an indicator LED 27 illustrated in FIG. 4 are attached to any one of the four attachment portions 332.

Figure 7:
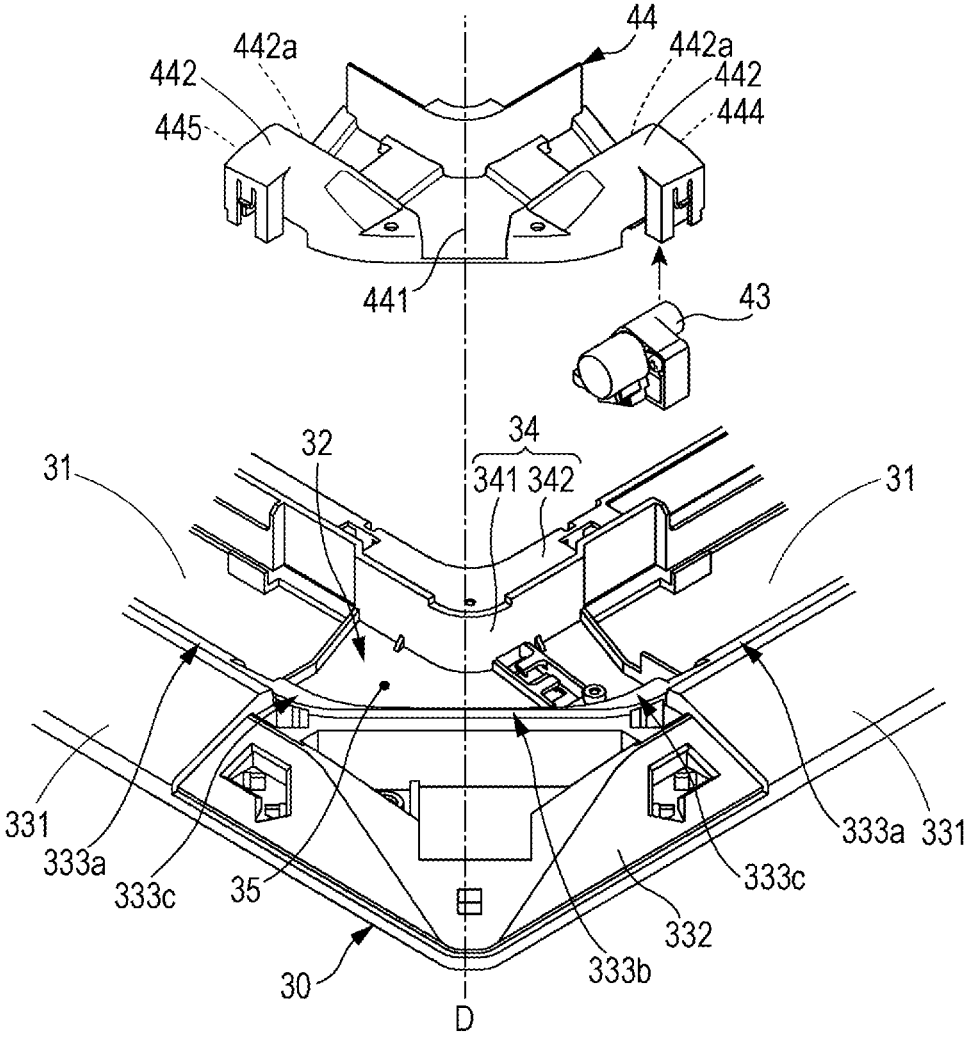
FIG. 7 is an illustrative view of the decorative panel, a motor, and a motor cover in the ceiling-embedded air conditioner.

As illustrated in FIGS. 5 and 7, portions of edge surfaces 333 of the outer frame portion 33 facing the blowoff path 32 and contacting the outlets 31 include linearly-formed first straight portions 333*a*. Portions of the edge surfaces 333 coupled to the coupling portions 35 include second straight portions 333*b* and arc parts 333*c*. The second straight portions 333*b* are inclined 45 degrees relative to the first straight portions 333*a*. The arc parts 333*c* couple the first straight portions 333*a* and the second straight portions 333*b* in a gentle arc shape.

As illustrated in FIGS. 5 and 6, the decorative surfaces 331 and the attachment portions 332 are coupled to the edge surfaces 333 by arc-shaped curved surfaces 334. Bearings 335 are provided in the middles of the edges surfaces 333. The bearings 335 protrude toward the outlets 31 to support pivotally the wind direction plates 5.

<Inner Frame Portion>

The inner frame portion 34 of the decorative panel main body 30 includes inner walls 341 and attachment bases 342 as illustrated in FIGS. 5 and 6. The inner walls 341 are erected at the blowoff path 32 side. The attachment bases 342 are provided on the entire inner circumference of the inner walls 341.

<Corner Panels>

As illustrated in FIG. 3, the corner panels 41 cover the respective four attachment portions 332 of the outer frame portion 33. The corner panels 41 are fixed to the decorative panel main body 30 by hooking locking claws 411 on the attachment portions 332 of the outer frame portion 33, and are flush with the decorative surfaces 331. The corner panels 41 also include locking claws (not illustrated) on the surfaces at the attachment portion 332 side.

In addition, the human detection sensor 26 and the indicator LED 27 attached to the attachment portions 332 protrude from the corner panels 41.

<Motor Covers>

As illustrated in FIGS. 5 and 7, the motors 43 rotating the respective four wind direction plates 5 are disposed in the blowoff path 32 under (above in FIG. 7) the coupling portions 35 of the decorative panel main body 30. The motors 43 are stored in the motor covers 44 fixed to the decorative panel main body 30 and serving also as motor fixtures. The motors 43 are integrated with the motor covers 44 and are fixed to the coupling portions 35 of the decorative panel main body 30.

This ensures the spaces for attachment of the motors 43. In addition, the motors 43 can be attached and detached through the surface of the decorative panel. Accordingly, the decorative panel 3 does not need to be removed from the housing 10 at the time of maintenance of the motors 43, for example. This results in improvement of workability.

The motor covers 44 abut on the edge surfaces 333 of the outer frame portion 33 and are symmetrical with respect to diagonal lines D of the decorative panel 3. Each of the motor covers 44 includes symmetrical motor storage portions 442 for storing the motors 43 at right and left sides.

That is, the motor covers 44 are symmetrical with respect to the diagonal lines D of the decorative panel 3 and include the two each motor storage portions 442 on the both sides of the diagonal lines D. The two motor storage portions 442 store the two motors 43 for driving the two wind direction plates 5 corresponding to the two outlets 31 coupled via the coupling portion 35. The bottom surfaces of the motor covers 44 are included in the corner blowoff units 36 described later (constituting bottom paths 441). The bottom paths 441 included in the corner blowoff units 36 described later may be formed between the motor storage portions 442 in the motor covers 44.

The motor storage portions 442 have the bottom paths 441. The bottom paths 441 are inclined so as to be higher at the outlet 31 side and lower at the inside of the blowoff path 32 and the diagonal line D sides of the decorative panel 3. The bottom paths 441 are disposed in parallel with the diagonal lines D of the decorative panel 3, for example, between the two symmetrical motor storage portions 442 and 442 in the motor covers 44. The bottom paths 441 are provided in correspondence with the coupling portions 35 of the blowoff path 32.

The motor storage portions 442 has a wall surface 444 at the outlet 31 side as illustrated in FIGS. 5 to 7. In addition, the motor storage portions 442 include inclined surfaces 442*a* on the side opposite to the outer frame portion 33. The inclined surfaces 442*a* have an inclination angle of about 60 degrees. The motor storage portions 442 for storing the motors 43 have a bearing 431 for the motor 43 on the one wall surface 444. The motor storage portions 442 have a bearing 445 for a shaft part 521 of the wind direction plate 5 described later on the other wall surface 444.

<Panel Heat Insulating Member>

The panel heat insulating member 45 is provided in the blowoff path 32 at the suction grill 40 side as illustrated in FIG. 3. The panel heat insulating member 45 has a curved surface 453 at the blowoff path 32 side as illustrated in FIG. 6. This allows the panel heat insulating member 45 (curved surface 453) to serve as a blowoff guide that guides the air W blown from the outlets 31 toward the air-conditioned room K.

Figure 11:
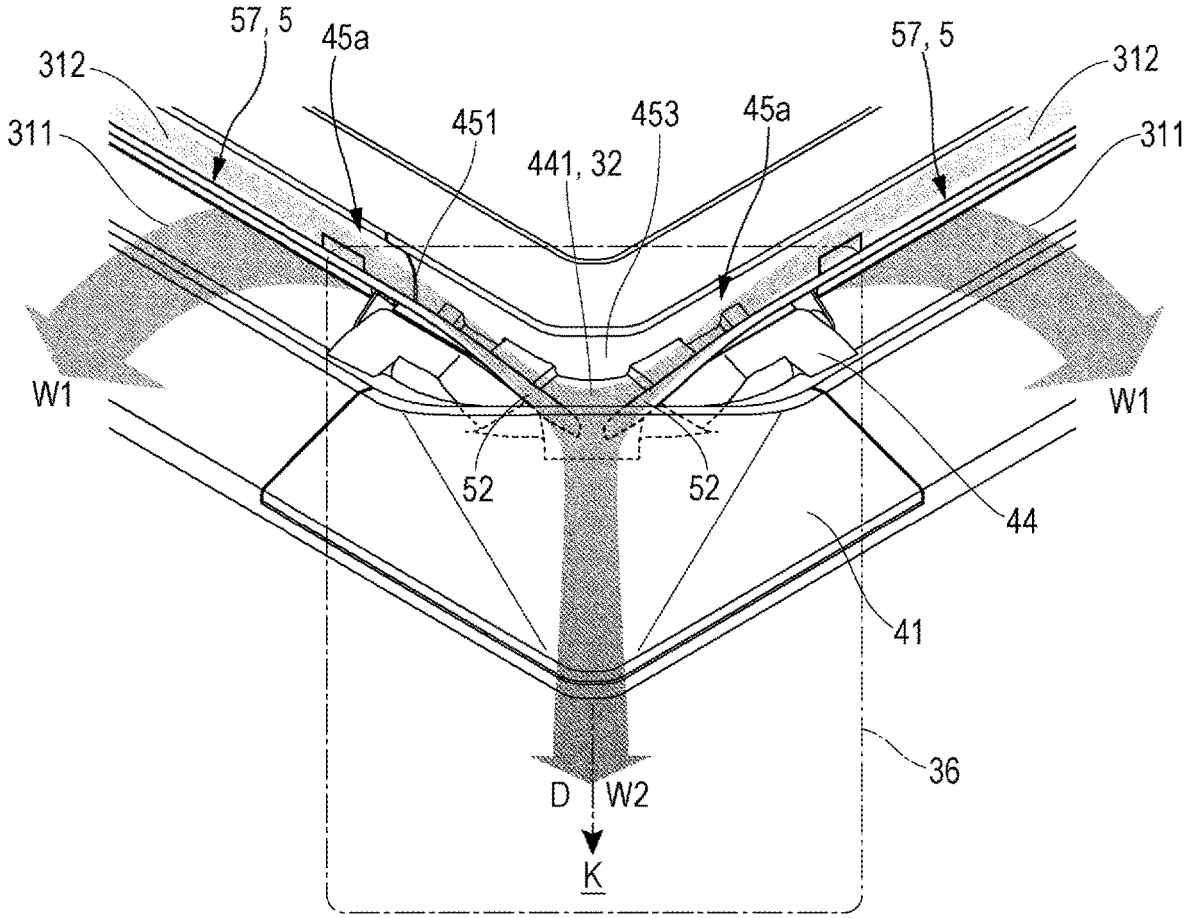
FIG. 11 is an illustrative view of a corner blowoff unit of the ceiling-embedded air conditioner.

The panel heat insulating member 45 is formed by combining four so-called L-shaped panel heat insulating member pieces 45*a* as illustrated in FIG. 5. In each of the panel heat insulating member pieces 45*a*, a long side part 454 and a short side part 455 are orthogonal to each other at a corner part 452. Abutment surfaces 451 of the adjacent panel heat insulating member pieces 45*a* are engaged with each other in the vicinities of the end portions of the outlets 31 as illustrated in FIG. 11. Since the panel heat insulating member pieces 45*a* are combined in the vicinities of the end portions of the outlets 31, a small misalignment at seams between the panel heat insulating member pieces 45*a* would have little influence on the blowoff air W. In addition, the seams between the panel heat insulating member pieces 45*a* are hidden behind the motor covers 44 and thus are less prominent.

The corner parts 452 of the panel heat insulating member 45 in abutment with the motor covers 44 also have curved surfaces 453 at the blowoff path 32 side. Accordingly, the panel heat insulating member 45 (curved surfaces 453) serves as a blowoff guide that guides auxiliary blowoff air W2 to the corner blowoff units 36 described later.

<Suction Grill Frame>

The panel heat insulating member 45 is sandwiched and held between the suction grill frame 46 and the inner walls 341 of the inner frame portion 34 of the decorative panel main body 30 as illustrated in FIGS. 5 and 6. The suction grill frame 46 includes a decorative surface 461 and a receiving part 462. The decorative surface 461 surrounds the suction grill 40 in a frame shape and is flush with the suction grill 40. The receiving part 462 is formed stepwise at the inner side of the decorative surface 461 to receive the suction grill 40. The receiving part 462 is screwed and fixed to the attachment bases 342 of the inner frame portion 34 of the decorative panel main body 30. Accordingly, the panel heat insulating member 45 is sandwiched between the decorative panel main body 30 and the suction grill frame 46. Since the panel heat insulating member 45 is sandwiched and fixed between the suction grill frame 46 and the decorative panel main body 30 as described above, the air conditioner 1 can be simplified in structure and easy to assemble. That is, the air conditioner 1 is improved in ease of assembly without the need for providing heat insulators at the outlets. This suppresses component costs.

The suction grill frame 46 is a square in shape, for example. The suction grill frame 46 includes tapered surfaces 464 at the corners at the blowoff path 32 side along the wind direction plates 5 described later.

<Suction Grill>

As illustrated in FIGS. 1 to 4, the square suction grill 40 is detachably attached to the inside of the suction grill frame 46. The suction grill 40 includes a plurality of dotted suction holes 401 for taking the air into the suction opening 16. A dedusting filter 42 is detachably held on the rear surface (upper surface in FIG. 2) of the suction grill 40.

As illustrated in FIG. 3, the suction grill 40 has rotation shafts 402 at two points of one side of peripheral edges. The suction grill 40 also has fastening brackets 403 on the rear surface. The decorative panel main body 30 has bearings 343 on the inner walls 341 of the inner frame portion 34. The suction grill frame 46 has bearings 463 at the receiving part 462. The bearings 343 and 463 pivotally sandwich and support the rotation shafts 402 of the suction grill 40. The fastening brackets 403 are locked in fastening bracket holes 342*a*. The fastening bracket holes 342*a* are provided in the attachment bases 342 of the inner frame portion 34 of the decorative panel main body 30. This allows the suction grill 40 to rotate via the rotation shafts 402 relative to the bearings 343 and 463. Therefore, the suction grill 40 can be rotated and removed from the decorative panel main body 30, and the suction grill 40 can be rotated in reverse and attached to the decorative panel main body 30. The suction grill 40 is fixed to the decorative panel main body 30 by locking the fastening brackets 403 in the fastening bracket holes 342*a*.

<Blowoff Path>

The components of the decorative panel 3 are combined to form the blowoff path 32 as described above. The outer walls of the blowoff path 32 include the edge surfaces 333 and the curved surfaces 334 of the outer frame portion 33 of the decorative panel main body 30. The inner walls of the blowoff path 32 include the panel heat insulating member 45. The panel heat insulating member 45 is fixed to the decorative panel main body 30 so as to be sandwiched between the inner walls 341 of the inner frame portion 34 of the decorative panel main body 30 and the suction grill frame 46. The bottom surface of the blowoff path 32 includes the outlets 31 and the coupling portions 35 (motor covers 44).

<Wind Direction Plates>

As illustrated in FIGS. 1 and 4, the wind direction plates 5 are provided to cover almost the entire blowoff path 32 provided at the decorative panel 3 on almost the entire circumference of the suction grill 40. The wind direction plates 5 are rotatably provided along the respective sides of the decorative panel 3 so as to cover or open the blowoff path 32. The wind direction plates 5 are longer than the long side of the outlet 31. The four wind direction plates 5 are the same in shape. The adjacent wind direction plates 5 have gaps therebetween at positions corresponding to the diagonal lines D of the square decorative panel 3.

As illustrated in FIGS. 2 and 6, the decorative panel 3 has the suction grill 40 and the suction grill frame 46 becoming higher toward the air-conditioned room K. The decorative panel 3 has a gently inclined portion from the blowoff path 32 side of the suction grill frame 46 to the decorative surfaces 331 of the outer frame portion 33 of the decorative panel main body 30. According to the inclination, the wind direction plates 5 are formed to be higher at the suction grill frame 46 side and lower at the edge surface 333 side of the outer frame portion 33.

As described above, in the air conditioner 1, the blowoff path 32 includes the concaves 32*a* continuously provided around the outlets 31 and the coupling portions 35. The wind direction plates 5 are rotatably attached into the concaves 32*a* (blowoff path 32) to cover or open the blowoff path 32 via shaft parts 511 described later. Therefore, when the air conditioner 1 is stopped (that is, the wind direction plates 5 cover the blowoff path 32), the wind direction plates 5 are flush or almost flush with the surface of the decorative panel 3. Therefore, the air conditioner 1 is improved in design.

Figure 8A:
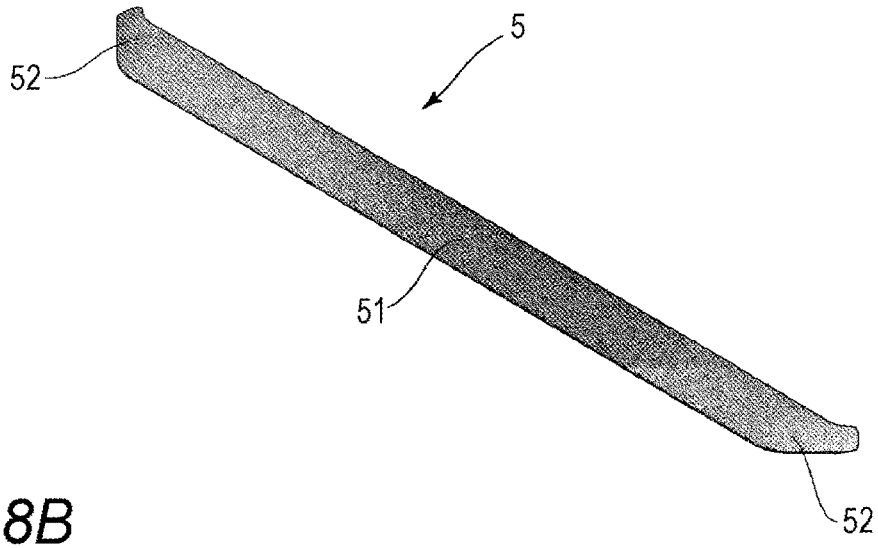
FIG. 8A is a perspective view of a wind direction plate in the ceiling-embedded air conditioner.
Figure 8B:
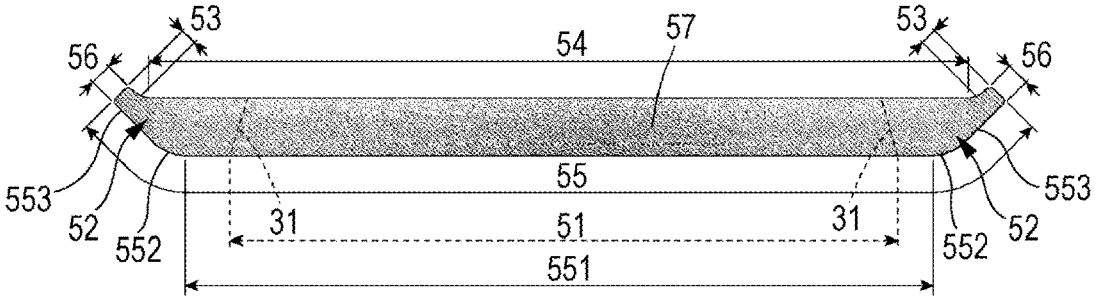
FIG. 8B is a plane view of the wind direction plate.

The wind direction plates 5 are longer than the long side of the outlet 31. As illustrated in FIGS. 4, 8A, and 8B, each of the wind direction plates 5 includes a wind direction portion 51, auxiliary wind direction portions 52, third side parts 53, a first side part 54, and a second side part 55. The wind direction portion 51 is opposed to the outlet 31. The auxiliary wind direction portions 52 are positioned at the ends of the wind direction portions 51 and are opposed to the coupling portions 35 of the decorative panel 3 (the positions (sections) of the blowoff path 32 corresponding to the coupling portions 35, that is, the motor covers 44). The first side part 54 is a peripheral edge of the wind direction plate 5 at the suction grill 40 side. The second side part 55 is a peripheral edge of the wind direction plate 5 at the outer frame portion 33 side (outer side) and is opposed to the first side part 54. The second side part 55 includes a straight portion 551 corresponding to the outlets 31 and inclined portions 553. The inclined portion 553 is inclined from the both ends of the straight portion 551 toward the ends of the first side part 54.

The third side parts 53 are positioned at the ends of the first side part 54 of the wind direction plate 5 and are parallel or almost parallel to the inclined portions 553 of the second side part 55. The wind direction plate 5 further has fourth side parts 56. The fourth side parts 56 are erected, at the adjacent wind direction plate 5 side, vertically relative to the inclined portions 553 from the one each end of the inclined portions 553 and are coupled to the third side parts 53.

Figure 8C:
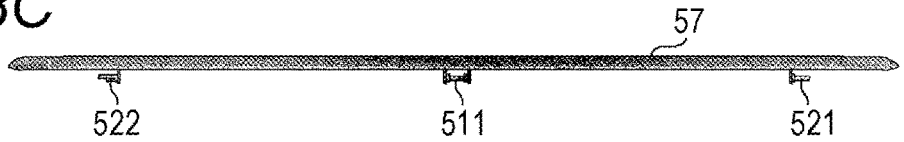
FIG. 8C is a front view of the wind direction plate.
Figure 8D:
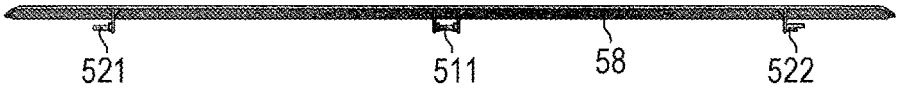
FIG. 8D is a rear view of the wind direction plate.
Figure 8E:
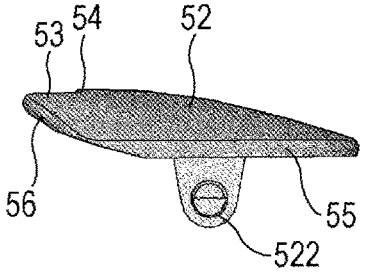
FIG. 8E is an enlarged side view of the wind direction plate.
Figure 8F:
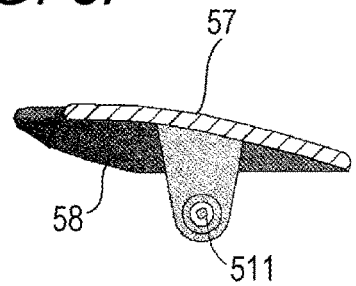
FIG. 8F is an enlarged cross-sectional view of the wind direction plate.

In the following description, the face of the wind direction plate 5 appearing on the decorative panel 3 side in the shutdown state will be designated as front face 57 as illustrated in FIG. 8B, and the face opposite to the front face 57 of the wind direction plate 5 will be designated as back face 58 as illustrated in FIG. 8F.

As illustrated in FIGS. 4 and 8B, the wind direction portion 51 has the first side part 54 and the second side part 55 that are lines in parallel or almost parallel with each other so as to correspond to the outlet 31. As illustrated in FIG. 8F, the wind direction portion 51 includes a gentle outward curve in the front face 57.

As illustrated in FIG. 8B, the first side part 54 is a line that is continuous from the wind direction portion 51 to the auxiliary wind direction portions 52. The third side parts 53 are provided at the ends of the first side part 54 and are parallel or almost parallel to the inclined portions 553 of the second side part 55. The fourth side parts 56 couples the both ends of the second side part 55 and the both ends of the third side parts 53 vertically or almost vertically relative to the second side part 55.

The first side part 54 and the third side parts 53 of the wind direction plate 5 described above are shaped in correspondence with the suction grill frame 46 illustrated in FIG. 4. The straight portion 551 of the second side part 55 is shaped in correspondence with the first straight portion 333*a* of the edge surface 333 of the outer frame portion 33 in the decorative panel main body 30 illustrated in FIG. 7. The inclined portions 553 of the second side part 55 are shaped in correspondence with the second straight portion 333*b* of the edge surfaces 333 of the outer frame portion 33. The second side part 55 further has second arc parts 552. The second arc parts 552 are positioned between the straight portion 551 and the inclined portions 553 and are shaped in correspondence with the arc part 333*c* of the edge surface 333 of the outer frame portion 33.

The coupling portions between the first side part 54 or the third side parts 53 and the second side part 55 at the ends of the fourth side parts 56 are formed in a round shape to avoid contact with the coupling portion of the adjacent wind direction plate 5 in the rotating state.

Referring to the front view of FIG. 8B, the auxiliary wind direction portions 52 appear to have the tips narrower than the wind direction portion 51. As illustrated in the side view of FIG. 8E, the first side part 54 and the second side parts 55 are almost the same in height. When the wind direction plate 5 covers the blowoff path 32, the front face 57 of the auxiliary wind direction portions 52 has an angle closer to the vertical direction than the front face 57 of the wind direction portion 51. Meanwhile, when the wind direction plate 5 opens the blowoff path 32 (at the maximum, for example), the front face 57 of the auxiliary wind direction portions 52 has an angle closer to the horizontal direction than the front face 57 of the wind direction portion 51.

Each of the wind direction plates 5 has a shaft part 511 on the back face 58 of the wind direction portion 51 as illustrated in FIGS. 8C and 8D. The shaft part 511 is pivotally supported by the bearing 335. The bearings 335 protrude from the outer frame portion 33 of the decorative panel main body 30 toward the outlets 31 and support pivotally the wind direction plates 5. Shaft parts 521 and 522 are provided on the back face 58 of the auxiliary wind direction portion 52. The shaft parts 521 are pivotally supported by the bearings 445 of the motor covers 44. The shaft parts 522 are pivotally supported by the motor bearings 431 of the motor covers 44.

<Shutdown State>

In the shutdown state of the air conditioner 1, as illustrated in FIGS. 1 and 4, the four adjacent wind direction plates 5 cover almost the entire blowoff path 32 (concaves 32*a*) surrounding the suction grill 40. Accordingly, the outlets 31 and the wind direction plates 5 are visually recognized as forming a line (narrow surface) parallel or almost parallel to the decorative panel 3 and the suction grill 40. This produces uniformity in design of the air conditioner 1. Thus, the design of the air conditioner 1 is improved.

<Operating State>

Figure 9:
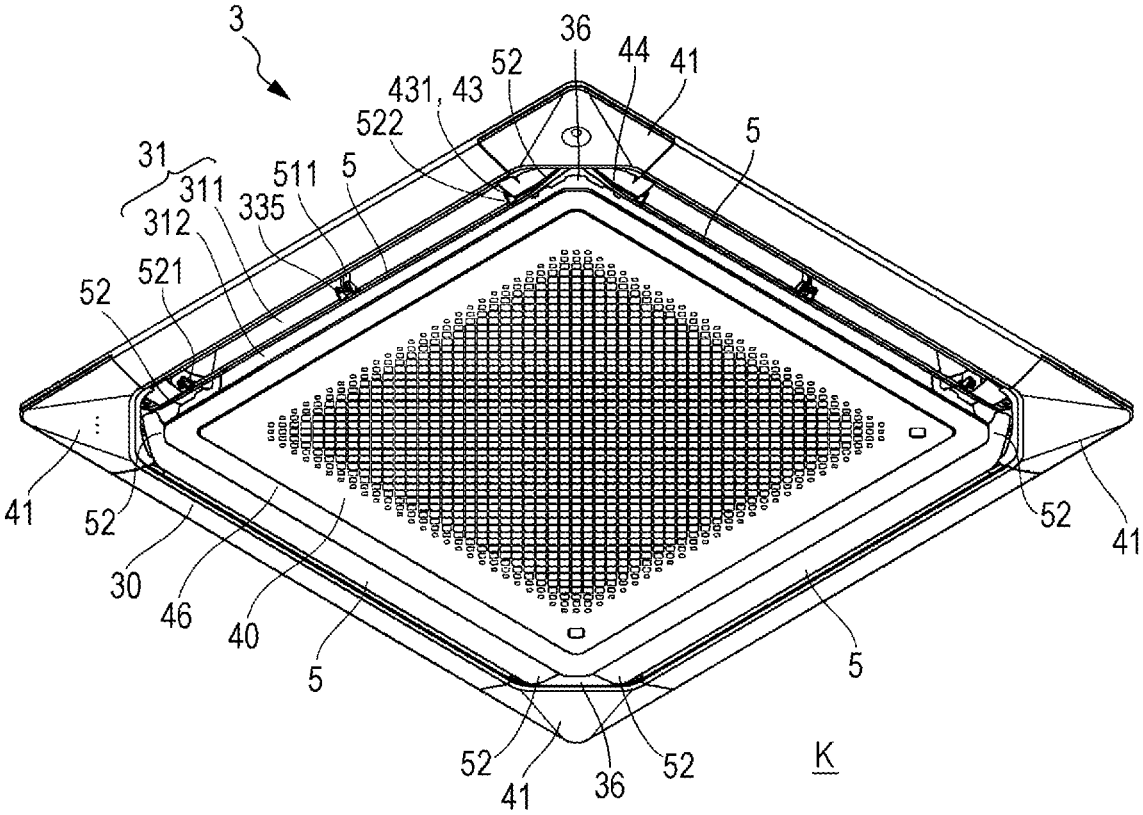
FIG. 9 is an external view of the ceiling-embedded air conditioner in the operating state.
Figure 10:
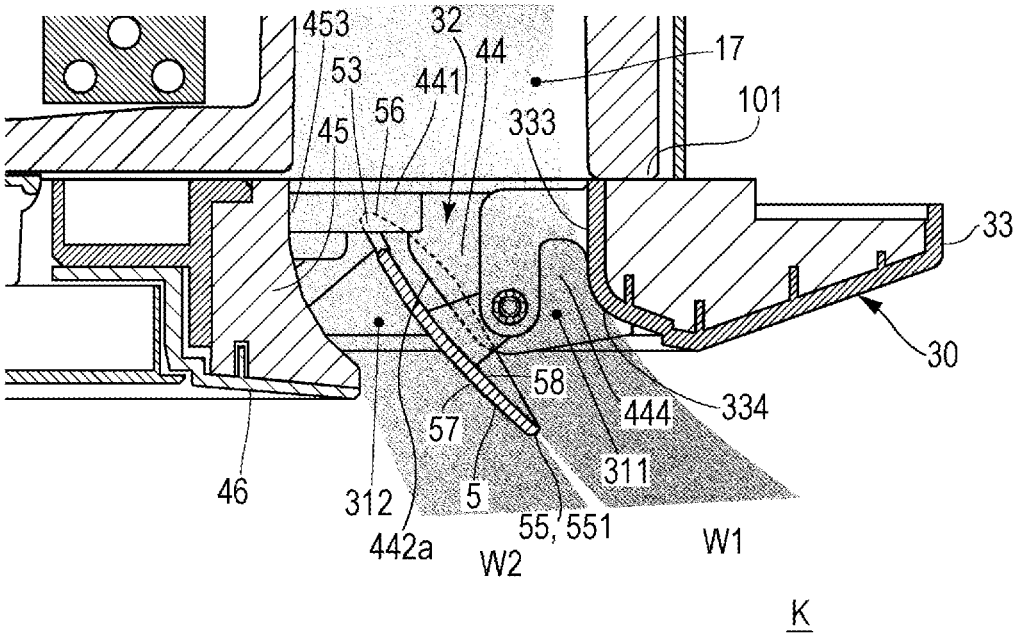
FIG. 10 is an enlarged view of FIG. 2 in the operating state.

When the air conditioner 1 starts operation, the motors 43 rotate the shaft parts 522 of the wind direction plates 5 pivotally supported by the motor bearings 431 as illustrated in FIGS. 9 and 10. Accordingly, the shaft parts 511 and 521 are also rotated. As a result, the wind direction plates 5 are rotated toward the blowoff path 32 at the first side part 54 side. The wind direction plates 5 can be rotated about 60 degrees at the maximum.

When the wind direction plates 5 are rotated, the first side parts 54 at the suction grill 40 side move into the blowoff path 32. The third side parts 53 and the fourth side parts 56 slide into the bottom paths 441 of the motor covers 44. Only the straight portions 551, some parts of the inclined portions 553, and the second arc parts 552 of the second side parts 55 of the wind direction plates 5 protrude from the decorative panel main body 30. That is, when the wind direction plates 5 open the blowoff path 32, the ends of the auxiliary wind direction portions 52 (third side parts 53 and fourth side parts 56) slide into the bottom paths 441. This prevents the ends of the wind direction plates 5 from appearing to project. As a result, the wind direction plates 5 are less prone to be prominent even in the operating state. Therefore, the air conditioner 1 can be made with a design excellent in appearance.

As illustrated in FIG. 10, when the wind direction plates 5 are rotated by the motors 43 to open the blowoff path 32, the spaces between the back faces 58 of the wind direction plates 5 and the inclined surfaces 442*a* of the motor covers 44 become narrower and thus the wind is unlikely to pass through the spaces. Accordingly, each of the outlets 31 is divided by the wind direction plate 5 into a main blowoff portion 311 and an auxiliary blowoff portion 312. The main blowoff portion 311 is surrounded by the back face 58 of the wind direction plate 5, the wall surface 444 of the motor storage portion 442 of the motor cover 44, the edge surface 333 of the outer frame portion 33, and the curved surface 334. The auxiliary blowoff portion 312 is positioned between the front face 57 of the wind direction plate 5 and the panel heat insulating member 45. The auxiliary blowoff portion 312 is coupled to the blowoff path 32.

The amount of air blown from the blowing fan 23 is larger at the hub 23*a* side of the blowing fan 23 due to a higher wind speed as illustrated in FIG. 2. Therefore, the amount of air flowing toward the heat insulating members 14 is larger in the blowing path 17. Accordingly, most of the air W passing through the outlets 31 is vigorously blown as air W1 from the main blowoff portions 311 into the air-conditioned room K.

Figure 12:
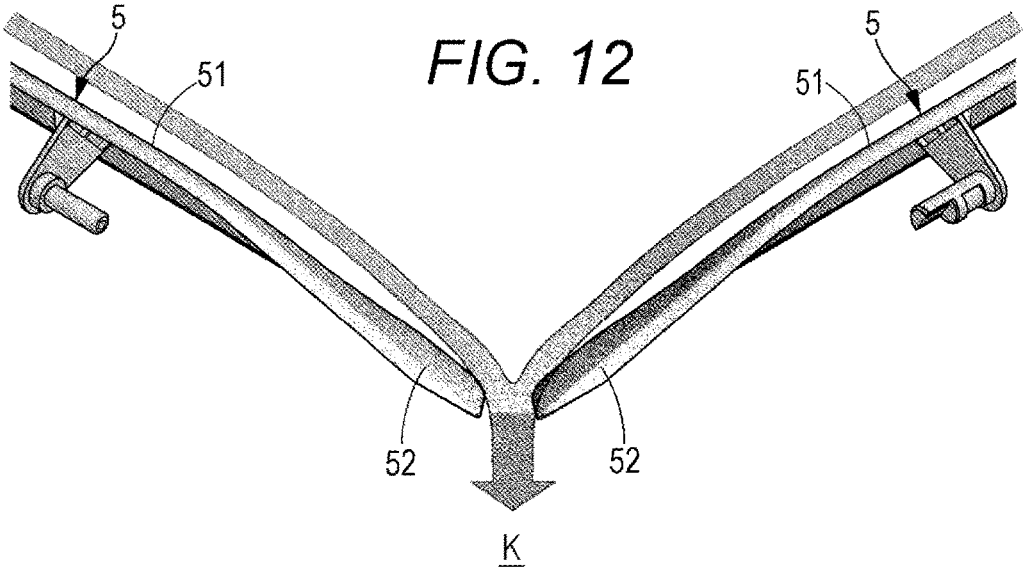
FIG. 12 is an illustrative view of the rotating wind direction plates in the ceiling-embedded air conditioner.

Meanwhile, the air blown from the auxiliary blowoff portions 312 is likely to spread due to a lower wind speed. Accordingly, part of the blown air W2 is guided to the corners of the blowoff path 32 along the space between the front faces 57 of the wind direction plates 5 at the auxiliary wind direction portions 52 and the blowoff path 32 as illustrated in FIGS. 11 and 12.

The bottom paths 441 of the motor covers 44 are positioned in the vicinities of the auxiliary wind direction portions 52 of the adjacent wind direction plates 5 and the corners of the blowoff paths 32. The bottom paths 441 and the auxiliary wind direction portions 52 of the adjacent wind direction plates 5 are included in the corner blowoff units 36. The corner blowoff units 36 are provided in the decorative panel 3 so as to correspond to the coupling portions 35 coupling the outlets 31. In a case where the faces of the wind direction plates 5 appearing on the decorative panel 3 side when the wind direction plates 5 covering the blowoff paths 32 are designated as front faces, the front faces of the auxiliary wind direction portions 52 partially constitute the corner blowoff units 36.

The air W2, which is guided by the auxiliary wind direction portions 52 of the wind direction plates 5 and reached the corners of the blowoff paths 32, joins together with the air W2, which is guided from the adjacent wind direction plates 5, at the bottom paths 441 of the motor covers 44.

The joining air W2 is blown toward vacant spaces. In this regard, the curved surfaces 453 of the panel heat insulating member 45 are positioned at the suction grill 40 side. Meanwhile, the third side parts 53 and the fourth side parts 56 at the tips of the auxiliary wind direction portions 52 of the wind direction plates 5 come under the bottom paths 441. Accordingly, the openings from the bottom paths 441 are wider outward along the extensions of the diagonal lines D.

This allows the joining air W2 to be blown outward along the extensions of the diagonal lines D.

When the wind direction plates 5 open the blowoff paths 32 (at the maximum, for example), the front faces 57 of the wind direction plates 5 at the auxiliary wind direction portions 52 have an angle closer to the horizontal direction than the front faces 57 of the wind direction portions 51. This allows the air W2 to be blown toward a wide area from the front faces 57 of the wind direction plates 5 at the auxiliary wind direction portions 52.

According to the foregoing configuration, even when the decorative panel 3 is not provided with auxiliary outlets, the air W2 blown from the auxiliary blowoff portions 312 is guided to the corners of the blowoff path 32 along the space between the auxiliary wind direction portions 52 of the wind direction plates 5 and the blowoff path 32. The bottom paths 441 are positioned in the vicinities of the auxiliary wind direction portions 52 of the adjacent wind direction plates 5 and the corners of the blowoff path 32. The air W2, which is guided to the auxiliary wind direction portions 52 of the wind direction plates 5 and reached the corners of the blowoff path 32, joins together with the air W2, which is guided from the adjacent wind direction plates 5, at the bottom paths 441.

The joining air W2 is blown toward vacant spaces. That is, the joining air W2 is blown from the tips of the auxiliary wind direction portions 52 of the adjacent wind direction plates 5 toward the outside of the decorative panel 3. Accordingly, the air conditioner 1 can blow air in all directions (or almost all directions) without having to provide auxiliary outlets unlike in the typical air conditioners. Therefore, the air conditioner 1 is a ceiling-embedded air conditioner that allows efficient air-conditioning in large rooms.

The present disclosure relates to a ceiling-embedded air conditioner with a housing embedded in a ceiling, more specifically, to a structure of outlets and wind direction plates. Alternatively, the present disclosure relates to a ceiling-embedded air conditioner with a housing embedded in a ceiling, more specifically, to a structure of outlets.

When the components of the decorative panel 3 are assembled, the blowoff path 32 may include the outer walls having the edge surfaces 333 and the curved surfaces 334 of the outer frame portion 33 of the decorative panel main body 30, the inner walls having the panel heat insulating member 45 which is sandwiched and fixed between the inner walls 341 of the inner frame portion 34 of the decorative panel main body 30 and the suction grill frame 46, and the bottom surface having the outlets 31 and the motor covers 44.

The first side parts 54 and the third side parts 53 of the wind direction plates 5 may be shaped in correspondence with the suction grill frame 46 illustrated in FIG. 4. The second side parts 55 may have the straight portions 551 aligned with the first straight portions 333*a* of the edge surfaces 333 of the outer frame portion 33 of the decorative panel main body 30 illustrated in FIG. 7, and may have the inclined portions 553 aligned with the second straight portions 333*b* of the edge surfaces 333 of the outer frame portion 33. The second side parts 55 may include the second arc parts 552 aligned with the arc parts 333*c* of the edge surfaces 333 of the outer frame portion 33 between the straight portions 551 and the inclined portions 553.

In the front view of FIG. 8B, the tips of the auxiliary wind direction portions 52 appear to be narrower than the wind direction portion 51. Alternatively, the heights of the first side part 54 and the second side part 55 may be parallel to each other as illustrated in the side view of FIG. 8E. The front face of the auxiliary wind direction portion 52 may have an angle closer to the vertical direction than the front face of the wind direction portion 51.

When the air conditioner 1 is in the shutdown state, the blowoff path 32 (concaves 32*a*) may surround the suction grill 40 and the four adjacent wind direction plates 5 may cover the entire blowoff path 32 surrounding the suction grill as illustrated in FIGS. 1 and 4.

The amount of air blown from the blowing fan 23 is large because the wind speed at the hub 23*a* side of the blowing fan 23 is high as illustrated in FIG. 2. Accordingly, a large amount of air flows toward the heat insulating members 14 through the blowing path 17 and most of the air W passing through the outlets 31 is vigorously blown as the air W1 from the main blowoff portions 311 into the air-conditioned room K.

The ceiling-embedded air conditioner according to this embodiment may be any one of the following first to ninth ceiling-embedded air conditioners.

The first ceiling-embedded air conditioner includes a box-shaped housing embedded in a ceiling of an air-conditioned room and a square decorative panel attached to the lower surface of the housing to cover the ceiling, the housing including a blowing fan and a heat exchanger that surrounds the blowing fan at the center and a drain pan at the lower side, the drain pan being provided with a suction opening that takes the air into the blowing fan and main body outlets that blow heat-exchanged air along the respective four sides of the box-shaped housing, and the decorative panel being provided with a suction grill in correspondence with the suction opening and elongated rectangular outlets in correspondence with the main body outlets. The decorative panel has concaves formed around the outlets and continuously coupled to form a blowoff path and has wind direction plates that are longer than the long side of the outlet and are provided along the respective sides of the decorative panel to cover the blowoff path. The wind direction plates have wind direction portions, which are opposed to the outlets, and auxiliary wind direction portions opposed to the blowoff path at the ends of the wind direction portions. The blowoff path includes bottom paths at the corners in parallel to the diagonal lines of the decorative panel. When the wind direction plates are rotated and the suction grill sides of the wind direction plates move into the blowoff path, the auxiliary wind direction portions of the wind direction plates and the bottom paths form corner blowoff units.

In the second ceiling-embedded air conditioner according to the first ceiling-embedded air conditioner, in a case where the faces of the wind direction plates appearing on the decorative panel side when the wind direction plates cover the blowoff path are designated as front faces, the front faces of the auxiliary wind direction portions partially constitute the corner blowoff units.

In the third ceiling-embedded air conditioner according to the first or second ceiling-embedded air conditioner, each of the wind direction plates includes: a long first side part that is arranged at the suction grill side; a second side part that is opposed to the first side part and includes a straight portion in correspondence with the outlet and inclined portions inclined from the both ends of the straight portion toward the ends of the first side part; third side parts that are parallel to the inclined portions of the second side part at the ends of the first side parts; and fourth side parts that are erected from the ends of the inclined portions in the direction vertical to the inclined portions and are coupled to the third side parts. When the wind direction plate is opened at the maximum, the third side parts and the fourth side parts come under the bottom surface of the blowoff path.

In the fourth ceiling-embedded air conditioner according to any of the first to third ceiling-embedded air conditioners, when the wind direction plates cover the blowoff path, the front faces of the auxiliary wind direction portions of the wind direction plates have an angle closer to the vertical direction than the front faces of the wind direction portions. When the wind direction plates are opened at the maximum, the front faces of the auxiliary wind direction portions of the wind direction plates have an angle closer to the horizontal direction than the front faces of the wind direction portions.

In the fifth ceiling-embedded air conditioner according to the first ceiling-embedded air conditioner, motors for rotating the wind direction plates and motor covers for storing the motors are attached in the blowoff path between the adjacent outlets. The bottom surfaces of the motor covers constitute the bottom paths.

In each of the first to fifth ceiling-embedded air conditioners, when the wind direction plates are rotated and the suction grill sides of the wind direction plates moves into the blowoff path, the air blown from the outlets is guided to the corners of the blowoff path along the space between the auxiliary wind direction portions of the wind direction plates and the blowoff path. The bottom paths are provided at the adjacent wind direction plates and the corners of the blowoff path. The air blown from the outlets joins together with the air, which is guided from the adjacent wind direction plates, at the bottom paths.

The joining air is blown toward vacant spaces. Accordingly, by blowing the air from the tips of the auxiliary wind direction portions of the adjacent wind direction plates to the outside of the decorative panel, the ceiling-embedded air conditioner allows air blowing in all directions without any auxiliary outlets and efficient air-conditioning in large rooms.

The sixth ceiling-embedded air conditioner includes a box-shaped housing embedded in a ceiling of an air-conditioned room and a square decorative panel attached to the lower surface of the housing to cover the ceiling, the housing including a blowing fan and a heat exchanger that surrounds the blowing fan at the center and a drain pan at the lower side, the drain pan being provided with a suction opening that takes the air into the blowing fan and main body outlets that blow heat-exchanged air along the respective four sides of the box-shaped housing, and the decorative panel being provided with a suction grill in correspondence with the suction opening and outlets in correspondence with the main body outlets. The decorative panel has concaves formed around the outlets and continuously coupled to form a blowoff path and has wind direction plates that are longer than the long side of the outlet and are provided along the respective sides of the decorative panel to cover the blowoff path. Motors for rotating the wind direction plates are fixed integrally with motor covers, for storing the motors, at the corners in the blowoff path.

In the seventh ceiling-embedded air conditioner according to the sixth ceiling-embedded air conditioner, the motor covers are symmetrical with respect to the diagonal lines of the decorative panel and include symmetrical motor storage portions for storing the motors on the both sides. Each of the motor storage portions is higher at the outlet side and lower at the inside of the blowoff path and the diagonal line sides of the decorative panel. The symmetrical motor storage portions have a bottom path therebetween.

In the eighth ceiling-embedded air conditioner according to the sixth or seventh ceiling-embedded air conditioner, when the wind direction plates are rotated by the motors, the outlets are divided into main blowoff portions and auxiliary blowoff portions and the motor storage portions of the motor covers form wall surfaces at the main blowoff portion side.

In the ninth ceiling-embedded air conditioner according to any of the sixth to eighth ceiling-embedded air conditioners, when the wind direction plates are rotated by the motors, the wind direction plates, the spaces between the adjacent wind direction plates, and the bottom paths form corner blowoff units that guide the air in the auxiliary blowoff portions.

In each of the sixth to ninth ceiling-embedded air conditioners, the decorative panel has the blowoff path that is formed by the concaves continuously coupling the outlets and has the wind direction plates that are provided to cover the blowoff path along the respective sides of the decorative panel. Accordingly, the air conditioner allows air blowing in all directions without having to provide auxiliary outlets. The motors for rotating the wind direction plates are fixed integrally with the motor covers, for storing the motors, at the corners of the blowoff path to ensure the spaces for attachment of the motors in spite of an all-direction blowoff type. In addition, the motors can be attached and detached through the surface of the decorative panel to eliminate the need for removing the decorative panel from the housing at the time of maintenance of the motors, for example, thereby resulting in improvement of workability. Further, the motor covers are symmetrical with respect to the diagonal lines of the decorative panel and include the symmetrical motor storage portions for storing the motors at the both sides. The motor covers have bottom paths between the symmetrical motor storage portions, which allows the airs guided to the wind direction plates to join together at the bottom paths and blow outward along extensions of the diagonal lines of the decorative panel. Accordingly, the motor covers form part of the corner blowoff units.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A ceiling-embedded air conditioner comprising:

a box-shaped housing that is embedded in a ceiling of an air-conditioned room; and a square decorative panel that is attached to a lower surface of the housing and covers the ceiling, wherein the housing comprises:

a blowing fan at a center of inside of the housing;

a heat exchanger surrounding the blowing fan; and a drain pan at a lower part of the housing, the drain pan having a suction opening for taking air in the blowing fan and main body outlets that are provided along respective four sides of the box-shaped housing, the main body outlets blowing heat-exchanged air, the decorative panel comprises:

a suction grill corresponding to the suction opening;

outlets corresponding to the main body outlets;

a blowoff path having a concave shape around each of the outlets; and wind direction plates along the respective four sides of the decorative panel, each of the wind direction plates being longer than a long side of each of the outlets and covering the blowoff path, each corner of the blowoff path comprises a motor for rotating each of the wind direction plates and a motor cover including a motor storage portion for storing the motor, the motor and the motor cover being integrally fixed to the blowoff path, when the each of the wind direction plates is rotated by the motor, each of the outlets is divided into a main blowoff portion and an auxiliary blowoff portion by the each of the wind direction plates, and a corner blowoff unit that guides air in the auxiliary blowoff portion is formed, the corner blowoff unit comprises:

two of the wind direction plates adjacent to each other;

a space which is formed between the two of the wind direction plates adjacent to each other when the each of the wind direction plates is rotated by the motor; and the motor cover, part of the air blown from the auxiliary blowoff portion is guided to corners of the blowoff path along a space between each of the wind direction plates and the blowoff path, and the air guided from one of the wind direction plates joins together with the air guided from another one of the wind direction plates adjacent to the one of the wind direction plates and is blown out, the motor storage portion of the motor cover comprises a wall surface in the main blowoff portion, the ceiling-embedded air conditioner further comprises a panel heat insulating member around the suction grill, the main blowoff portion is surrounded by a back face of each of the wind direction plates, the wall surface of the motor storage portion and an outer frame portion of the decorative panel, the auxiliary blowoff portion is surrounded by a front face of the each of the wind direction plates and the panel heat insulating member, the motor storage portion further comprises an inclined surface on a side opposite to the outer frame portion of the decorative panel, and when the wind direction plates are rotated by the motor, a space between the back face of each of the wind direction plates and the inclined surface becomes narrower than the space between the back face of each of the wind direction plates and the inclined surface before the wind direction plates are rotated by the motor such that the air passing through the space is minimized.

2. The ceiling-embedded air conditioner according to claim 1, wherein the motor cover comprises a bottom path at a bottom surface of the motor cover.

3. The ceiling-embedded air conditioner according to claim 2, wherein the corner blowoff unit comprises:

the two of the wind direction plates adjacent to each other;

the space which is formed between the two of the wind direction plates adjacent to each other when the each of the wind direction plates is rotated by the motor; and the bottom path of the motor cover.

* * * * *